US005647153A

United States Patent [19]

Gervais

[11] Patent Number: 5,647,153

[45] Date of Patent: Jul. 15, 1997

[54] UNIVERSAL SNOW PLOW MOUNTING FRAME ASSEMBLY

[76] Inventor: Steve Gervais, 78 Baptist St., Swansea, Mass. 02777

[21] Appl. No.: 581,066

[22] Filed: Dec. 29, 1995

[51] Int. Cl.[6] ..... E01H 5/04

[52] U.S. Cl. ..... 37/231; 37/234; 37/236; 172/272

[58] Field of Search ..... 37/231, 232, 236, 37/235, 234; 172/272, 273, 817, 274, 275

[56] References Cited

U.S. PATENT DOCUMENTS

| | | | |
|---|---|---|---|
| 3,605,906 | 9/1971 | Coates | 172/272 |
| 3,987,562 | 10/1976 | Deen et al. | 37/231 |
| 4,304,056 | 12/1981 | Watson et al. | 37/231 X |
| 4,342,163 | 8/1982 | Hoekstra | 37/231 |
| 4,369,590 | 1/1983 | Miller | 37/231 |
| 4,817,307 | 4/1989 | Hardgrove | 37/231 X |
| 4,962,599 | 10/1990 | Harris | 37/234 X |
| 5,050,321 | 9/1991 | Evans | 37/232 |
| 5,075,988 | 12/1991 | Ciula | 37/231 |
| 5,081,775 | 1/1992 | Veilleux | 37/231 X |
| 5,111,603 | 5/1992 | Knowlton et al. | 37/231 |
| 5,125,174 | 6/1992 | Watson et al. | 37/231 |
| 5,136,795 | 8/1992 | Rosenberg | 37/231 |
| 5,265,355 | 11/1993 | Daniels | 37/231 |
| 5,346,018 | 9/1994 | Koster | 37/231 X |
| 5,353,530 | 10/1994 | Pieper | 37/231 |

*Primary Examiner*—Terry Lee Melius
*Assistant Examiner*—Thomas A. Beach
*Attorney, Agent, or Firm*—Salter & Michaelson

[57] ABSTRACT

A snow plow mounting frame assembly is capable of being attached to nearly any type of four wheeled vehicle having a chassis, and is capable of mounting thereon nearly any make and model of commercially available snow plow blades. The mounting frame assembly includes a horizontally disposed, heavy duty bumper member which is mounted on the chassis of the vehicle, and a pair of spaced-apart, vertically disposed support members which are mounted on the bumper member forwardly thereof. A pair of lateral support arms, one for each support member, each have one end pivotally attached to the lower portion of its respective support member and its other, opposite end pivotally attached to the chassis of the vehicle. A tube having a plurality of plates is releasably and adjustably attached to the lower portions of the support members for mounting a snow plow blade thereon.

8 Claims, 4 Drawing Sheets

UNIVERSAL SNOW PLOW MOUNTING FRAME ASSEMBLY

BACKGROUND AND SUMMARY OF THE INVENTION

This invention relates generally to snow plow mounting frame assemblies, and more particularly to a snow plow mounting frame assembly which is capable of being attached to almost any type of vehicle, including mid- to full-size pickup trucks, vans, and the like.

The present invention is in the same general field as U.S. Pat. Nos. 3,605,906 to Coates, 5,050,321 to Evans, and 5,353,530 to Pieper. However, none of these patents are directed to a snow plow mounting frame assembly which can be attached to almost any type of vehicle, including mid- to full-size pickup trucks, vans, etc. Moreover, none of these frame assemblies are capable of mounting thereon almost any type of commercially available snow plow blade. Heretofore, for each make and year, a separate and unique mounting frame assembly was required for that particular truck design. Moreover, the frame assembly could only receive and mount thereon one type of snow blade.

The foregoing illustrates limitations known to exist in present snow plow mounting frame assemblies. Thus, it is apparent that it would be advantageous to provide an improved mounting frame assembly directed to overcoming one or more of the limitations set forth above. Accordingly, a suitable alternative is provided including features more fully disclosed hereinafter.

Accordingly, among the several objects of the present invention are the provision of an improved snow plow mounting frame assembly which can mount on almost any type of vehicle, including mid- to full-size pickup trucks, vans, and the like; the provision of such a mounting frame assembly which can mount thereon almost any type of commercially available snow plow blade; the provision of such a mounting frame assembly which is easy to install with a drill and hand tools; the provision of such a mounting frame assembly which reduces the need of suppliers of such assemblies to stock many different makes and models of frame assembles; the provision of such a mounting frame assembly having component parts which are releasably and adjustably mounted on support members; and the provision of such a mounting frame assembly which is sturdy in construction, and has a neat, clean appearance.

In general, the present invention is directed to a snow plow mounting frame assembly capable of being attached to nearly any type of four wheeled vehicle having a chassis, and capable of mounting thereon nearly any make and model of commercially available snow plow blades. The mounting frame assembly comprises a horizontally disposed, heavy duty bumper member which is mounted on the chassis of the vehicle, and a pair of spaced-apart, vertically disposed support members which are mounted on the bumper member forwardly thereof. Each support member has an upper portion extending above the bumper member and a lower portion extending below the bumper member. A pair of lateral support arms, one for each support member, each have one end pivotally attached to the lower portion of its respective support member and its other, opposite end pivotally attached to the chassis of the vehicle. Means is provided for mounting a snow plow blade thereon, the mounting means being releasably and adjustably attached to the lower portions of the support members.

More specifically, the mounting means of the present invention comprises a horizontally disposed bar having opposite ends, each end of the bar having an end plate with a plurality of openings formed therein which are aligned with openings formed in the support member for releasably and adjustably attaching the bar at a desired elevation to the support members. The mounting means further comprises a plurality of snow plow blade receiving plates, each having a plurality of openings formed therein for attaching thereto a snow plow blade.

Additionally, the mounting frame assembly includes a plow blade lift assembly having a piston pivotally attached at one end thereof to the bumper member. A plow blade lift cross support member is mounted on the upper portions of the support members for attaching thereto a lift bar pivotally attached at one of its ends to the cross support member and pivotally attached at its other, opposite end to the other end of the piston.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
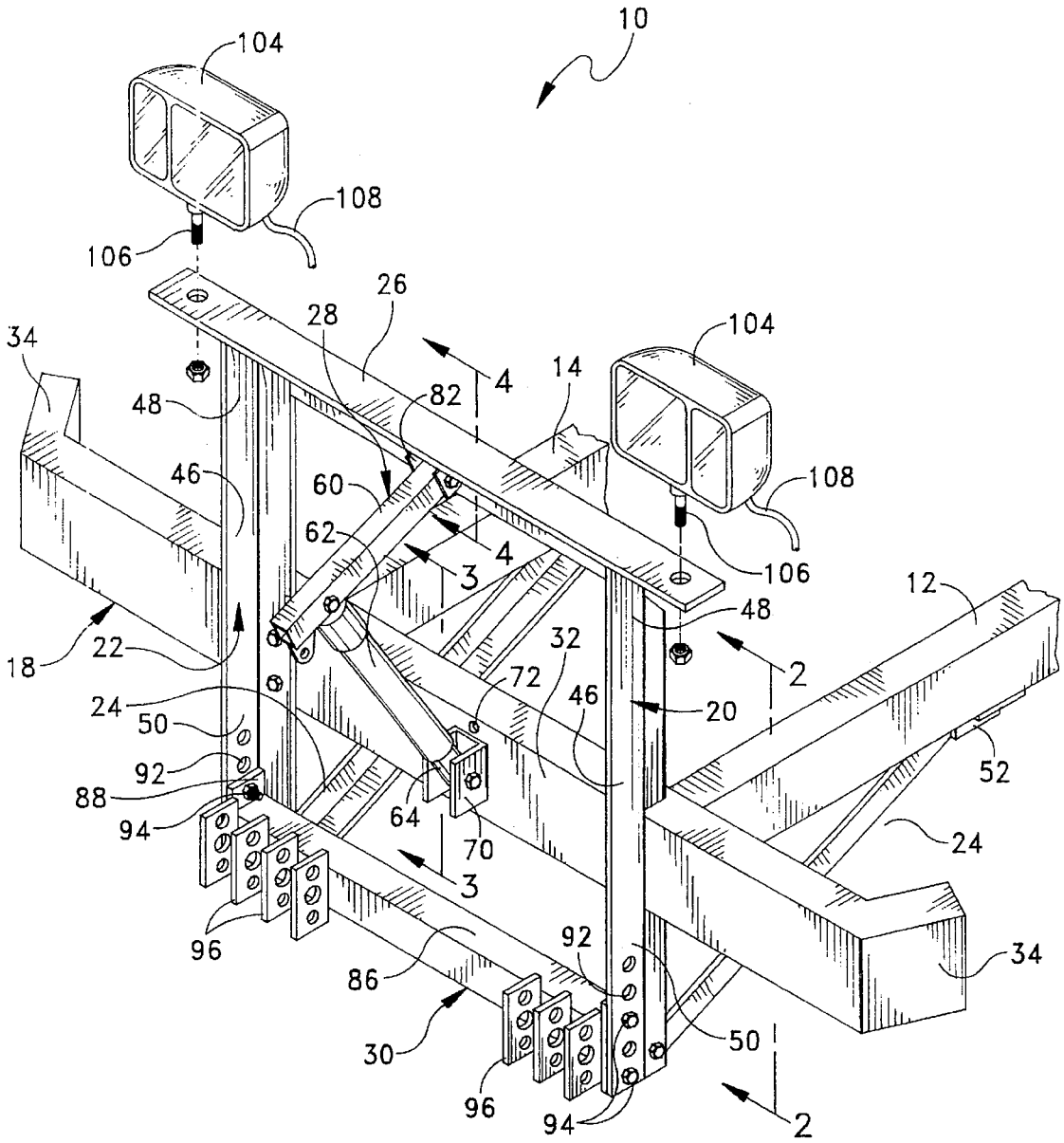
FIG. 1 is a perspective view of a universal snow plow mounting frame assembly of the present invention.
Figure 2:
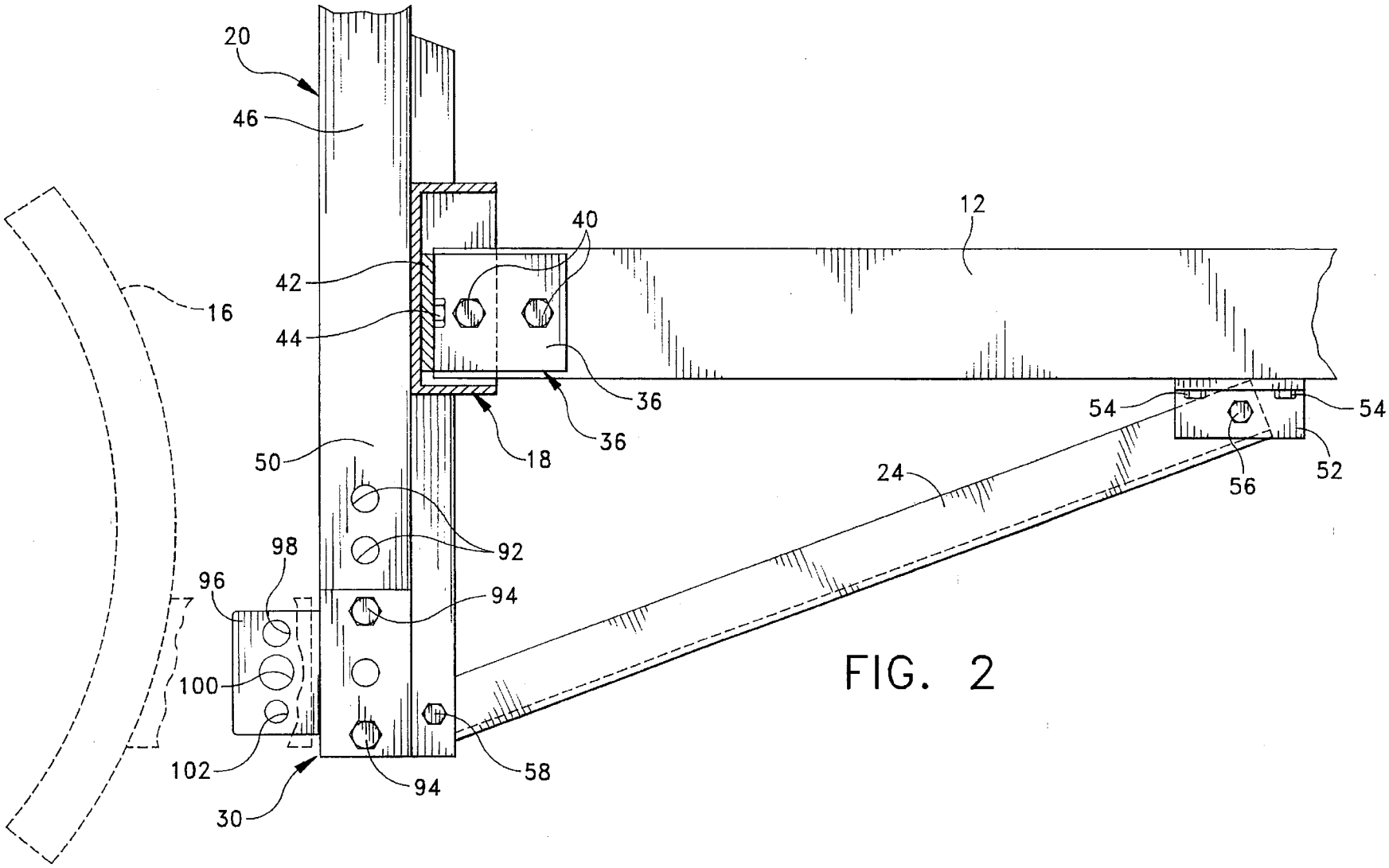
FIG. 2 is a cross-sectional view taken along line 2—2 of FIG. 1.

Referring now to the drawings, and more particularly FIG. 1, there is generally indicated at 10 a snow plow mounting frame assembly of the present invention. The mounting frame assembly 10 is capable of being mounted on laterally spaced-apart rail members 12, 14 of a truck chassis after the truck's existing front bumper (not shown) is removed therefrom. As will become more apparent as the description of the mounting frame assembly 10 proceeds, the assembly can be mounted on nearly any type of vehicle, including mid- to full-size pickup trucks, vans, and the like. Moreover, the mounting frame assembly 10 is especially suited for mounting thereon nearly any type of commercially available snow plow blade. In FIG. 2 of the drawings, there is illustrated in broken lines a snow plow blade 16 of standard construction mounted on the mounting frame assembly 10.

Referring now to FIGS. 1 and 2, the mounting frame assembly 10 comprises a horizontally disposed, heavy duty bumper member, generally indicated at 18, a pair of spaced-apart vertically disposed support members, generally indicated at 20, 22, a pair of lateral support arms, each indicated at 24, a top cross support member 26, a plow blade lift assembly, generally indicated at 28, and means for mounting a snow plow blade to the support members, generally designated at 30. Each of these components of the mounting frame assembly 10 are preferably fabricated from rugged, durable material, such as steel.

The bumper member 18 has a C- or channel-shaped body portion 32, and two cantered end portions 34. As illustrated in FIG. 2, the bumper member 18 is attached to the rail members 12, 14 of the truck's chassis by a pair of L-shaped frame rail brackets 36. For each bracket 36, one leg 38 is fastened to the rail member (e.g., rail member 12 in FIG. 2) of the chassis by a pair of suitable fasteners 40 (e.g., a bolt and nut fastener). The installer must drill clearance openings in each rail member 12, 14 which are aligned with openings formed in the brackets 36. Preferably, the other leg 42 of each bracket 36 is bolted to the inner surface of the body portion 32 of the bumper member 18. The installer must also drill the necessary clearance holes in the body portion 32 for accommodating another pair of fasteners 44 which mount the bumper member 18 to the second leg 42 of the bracket 36. The arrangement is such that the bumper member 18 must be securely fastened to the truck's chassis for supporting the substantial weight of the snow plow blade 16 and the remaining components of the mounting frame assembly 10.

Each support member 20, 22 comprises an elongate body 46 fabricated from L-shaped angle iron having an upper portion 48 which extends above the bumper member 18 and is attached (e.g., by welding) to the cross support member 26, and a lower portion 50 which extends below the bumper member 18 and is attached to its respective lateral support arm 24 and the mounting means 30 of the present invention. The support members 20, 22 are welded to the body portion 32 of the bumper member 18. Fasteners 44 are used to attach the complete assembly 10 to bracket 36. An advantage to this is that the bumper member 18 can be vertically adjusted by drilling clearance openings through the support members.

Still referring to FIGS. 1 and 2, the lateral support arms 24 are each attached at one end thereof if need be by a bracket 52 to its respective rail member 12 or 14 of the chassis, and at its other end to the lower portion 50 of its respective support member 20 or 22. The brackets 52 are suitably attached by a pair of fasteners 54 to the rail members 12, 14 wherein the ends of the lateral support arms 24 are pivotally attached to the brackets 52 by another fastener 56. The other ends of the lateral support arms 24 are also pivotally attached to their respective support members 20 or 22 by yet another fastener 58. It should be pointed out that the lateral support arms 24 and their brackets 52 enable the mounting frame assembly 10 of the present invention to mount on any type of vehicle and is not limited to any specific make, model and/or year. Preferably, the brackets 52, when required, are mounted on the underside or downwardly facing surface of the rail members 12, 14.

Figure 3:
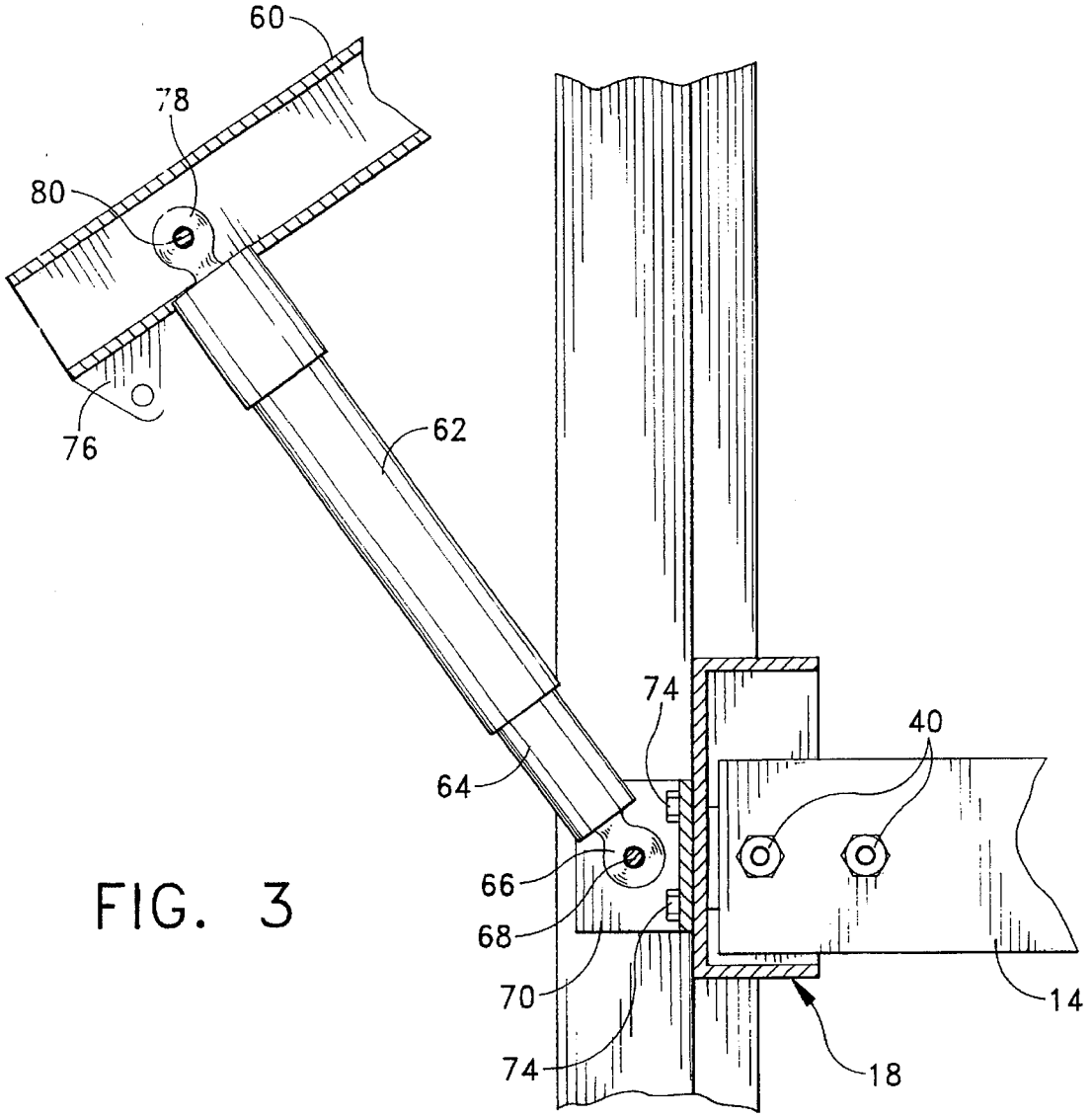
FIG. 3 is a cross-sectional view taken along line 3—3 in FIG. 1.
Figure 4:
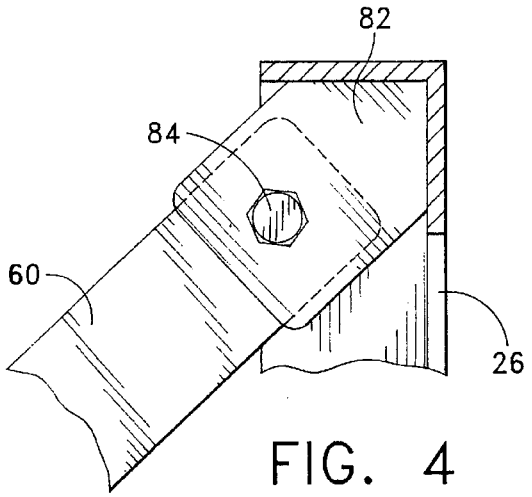
FIG. 4 is a cross-sectional view taken along line 4—4 of FIG. 1.

Turning now to FIGS. 1, 3 and 4, the plow blade lift assembly 28 comprises a lift bar 60 which is pivotally and releasably attached to the cross support member 26, a hydraulic cylinder 62 of the expansible chamber type which is pivotally attached to the lift bar 60, and a hydraulic piston 64, receivable within the cylinder 62, which is pivotally attached to the bumper member 18. More specifically, as illustrated in FIG. 3, the piston 64 has its lower end portion 66 attached via fastener 68 to a U-shaped bracket 70. Preferably, the bracket 70 has a pair of aligned apertures which can be registered with two of five vertically oriented apertures (each indicated at 72) formed in the body portion 32 of the bumper member 18 for adjustably attaching the bracket 70 to the bumper member 18 at a desired elevation. This enables the use of various size hydraulic units/cylinders and maximizes plow lift height. The bracket 70 is releasably attached to the bumper member 18 by suitable fasteners 74.

The other end portion (not designated) of the piston 64 is received within the cylinder 62 in the well-known manner and is movable therein between a retracted position (see FIG. 1) in which the piston 64 is nearly completely received within the cylinder 62, and an extended position in which hydraulic fluid is delivered to a chamber of the cylinder 62 for extending the piston 64 relative to the cylinder 62 thereby pivoting the lift bar 60 upwardly. The lift bar has a chain receiving member 76 welded at its outer end for receiving a chain (not shown) which is attached to the snow plow blade 16. The arrangement is such that the movement of the piston 64 from its retracted position to its extended position lifts the plow blade 16 off the ground. Suitable hydraulic fluid lines (not shown) are provided for delivering the hydraulic fluid to the chamber of the cylinder 62. The upper end portion 78 of the cylinder 62 is pivotally attached to the hollow rectangle lift bar 60 in the manner illustrated in FIG. 3. Again, a suitable fastener 80 is provided for this attachment. FIG. 4 illustrates the attachment of lift bar 60 to the cross support member 26. As shown, another U-shaped bracket 82 is mounted (as by welding) to the cross support member 26 whereby aligned openings in the U-shaped bracket 82 and the lift bar receive another fastener 84 for pivotally attaching the lift bar 60 thereto.

Figure 5:
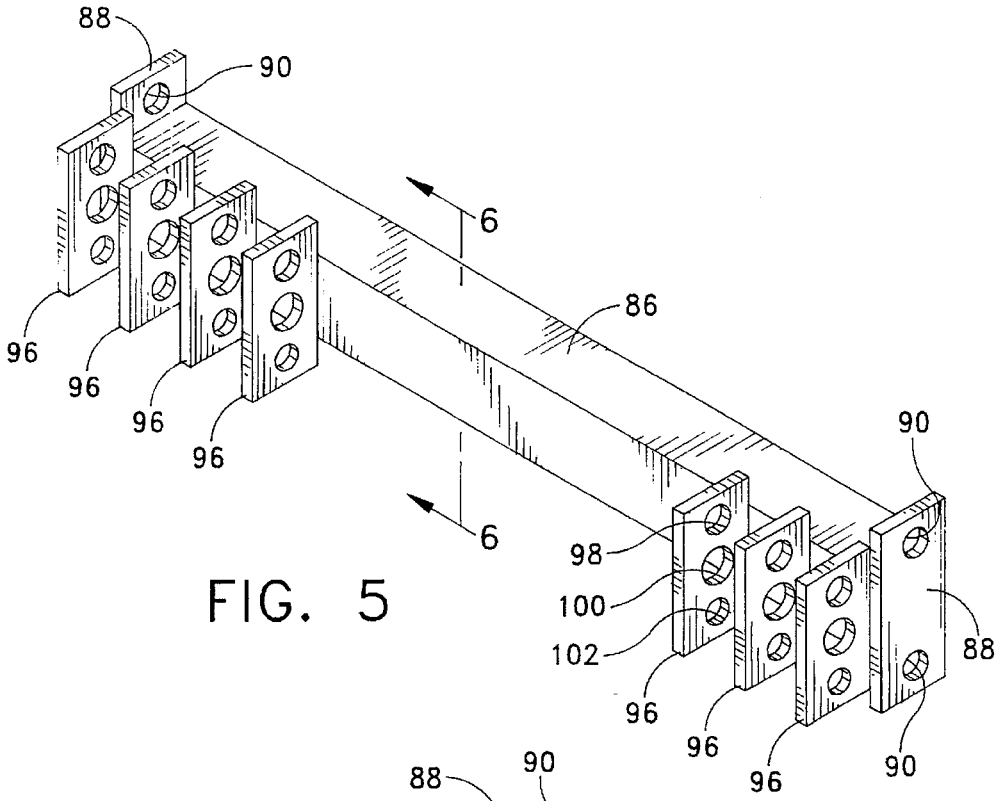
FIG. 5 is a perspective view of a plow blade receiving member of the mounting frame assembly.
Figure 6:
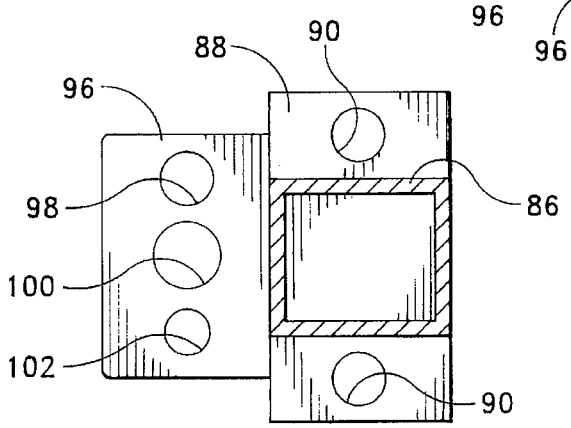
FIG. 6 is a cross-sectional view taken along line 6—6 of FIG. 2.

Referring to FIGS. 1, 5 and 6, the mounting means 30 of the present invention includes a hollow square tube 86 which when mounted on the support members 20, 22 lies horizontally. The tube 86 has opposite ends, each with an end plate 88 welded thereon in the manner illustrated in FIG. 5 so that the end plates 88 are parallel to one another and lie along planes which are transverse to the direction of the tube 86. Each end plate 88 has a two openings 90 formed therein which, when attaching the tube 86 to the support members 20, 22, are aligned with two of four openings 92 formed in its respective support member 20 or 22 for releasably and adjustably attaching the tube 86 at a desired elevation. Suitable fasteners 94 connect the end plates 88 to their respective support members 20 or 22. It is important to note that new laws may require the plow frame to be removable. Thus, it should be pointed out that lift bar 60, bracket 70 and tube 86 may be easily removed from the basic bumper assembly.

The mounting means 30 of the present invention further comprises a plurality (e.g., seven as illustrated in the drawings) of snow plow blade receiving plates 96 for attaching the snow plow blade 16 thereto (see FIG. 2). The receiving plates 96 are also welded to the tube 86 along parallel planes which are transverse to the direction of the tube 86. By providing a plurality of plates 96, the mounting frame assembly 10 can accommodate snow plow blades having varying widths. This provides the assembly 10 of the present invention with a significant advantage over prior art frame assemblies (see, e.g., the Evans patent) since it can mount thereon most any type of commercially available snow plow blade. Each plate 96 has three openings 98, 100 and 102 (see FIG. 6) formed therein, each opening having a different diameter than the other openings. For example, as illustrated in FIG. 6, the top opening 98 has a diameter of $^{13}/_{16}$ths of an inch, the middle opening 100 has a diameter of $1^{1}/_{16}$ inches, and the bottom opening 102 has a diameter of $^{11}/_{16}$ths of an inch. These openings, having varying diameters, enable the mounting means 30 to receive and accommodate fastening pins (not shown) having varying diameters which attach the snow plow blade to the frame assembly in the well-known manner.

The mounting frame assembly 10 further includes a pair of head lamp units each indicated at 104 which are mounted on the cross support member 26 by fasteners 106. The head lamp units 104 are electrically attached to the vehicle by a pair of wires, each indicated at 108. Such head lamp units are well-known in the art.

To install the snow plow mounting frame assembly 10 onto a pickup truck, for example, the existing bumper is removed from the truck, including any brackets and fasteners used to mount the bumper thereto. Next, the L-shaped frame rail brackets 36 are attached to the forward ends of their respective chassis rail members 12, 14. As shown, one leg 38 of each bracket 36 is fastened to the rail member 12 or 14 of the chassis by a fastener 40. Clearance holes or openings are then drilled into the body portion 32 of the bumper member 18. These openings are aligned with the openings formed in the other leg 42 of the bracket 36 for receiving fasteners 44 to attach the bumper member 18 to the chassis rail members 12, 14.

The lateral support arms 24 are then pivotally attached to their respective lower portions 50 of the support members 20, 22 in the manner described above. The opposite ends of the support arms 24 are then either directly fastened to their respective chassis rail members 12 or 14, or attached thereto by the support arm brackets 52. It should be noted that when using the support arm brackets 52, they are preferably mounted on the downwardly facing surfaces of the rail members 12, 14. The lateral support arms 24 are preferably at a forty-five degree angle with respect to the rail members 12, 14. Next, the head lamp units 104 are electrically connected to the vehicle' electrical system, and the hydraulic lines (not shown) are suitably attached to the plow blade lift assembly 28. At this point, the mounting frame assembly 10 is ready to receive and mount thereon the snow plow blade 16. In most instances, the snow plow blade will have a pair of laterally spaced apart plates which are received between adjacent plates 96 of the mounting means 30. The snow plow plates will have openings which can be aligned with any of the three openings 98, 100 and 102 of the plates 96 depending on their diameter. A pair of fastening pins extend through the aligned openings of the plow blade and the mounting means 30 for securing the blade to the mounting frame assembly.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A universal snow plow frame assembly comprising:

a horizontally disposed bumper member affixed to a chassis of a vehicle;

a pair of spaced-apart, substantially vertically disposed support members affixed to the bumper member, each support member having an upper portion extending above the bumper member and a lower portions extending below the bumper member;

lateral support means attached between the lower portion of each support member and the chassis for supporting said support members relative to said chassis;

a horizontally disposed cross support member affixed between the upper portions of said support members;

a horizontally disposed snow plow blade mounting bar having first and second ends, said first and second ends each including at least three spaced receiving plates each having a plurality of vertically aligned openings formed therein, said receiving plates being spaced at predetermined distances to provide a plurality of mounting width configurations for accepting a plurality of different snow plow blades, said mounting bar being slidably received between the lower portions of said support members for sliding vertical movement relative to the support members;

means for releasably mounting the first and second ends of said mounting bar to said support members at a plurality of different elevations;

a lift bar having a first end pivotally attached to said cross support;

a piston having a first end pivotally attached adjacent a second end of said lift bar;

a piston mounting bracket pivotally attached to a second end of said piston for mounting said second end of said piston to said bumper member; and means for releasably mounting said mounting bracket to said bumper at a plurality of different elevations.

2. The universal snow plow frame assembly of claim 1 wherein said means for releasably mounting the first and second ends of said mounting bar to said support members comprises a plurality of spaced mounting holes in each of the lower portions of said support members, end plates attached to the respective first and second ends of said mounting bar, said end plates including at least two spaced openings therein which align with the spaced mounting holes in the support members, and fastener elements which are releasably received through the aligned mounting holes and spaced openings.

3. The universal snow plow blade frame assembly of claim 1 wherein said means for releasably mounting said mounting bracket to said bumper comprising a plurality of vertically aligned spaced mounting apertures in said bumper member, two spaced mounting holes in said mounting bracket which align with said spaced apertures in said bumper member, and fastener elements which are releasably received through the aligned mounting holes and spaced mounting apertures.

4. The universal snow plow blade frame assembly of claim 2 wherein said means for releasably mounting said mounting bracket to said bumper comprising a plurality of vertically aligned spaced mounting apertures in said bumper member, two spaced mounting holes in said mounting bracket which align with said spaced apertures in said bumper member, and fastener elements which are releasably received through the aligned mounting holes and spaced mounting apertures.

5. The universal snow plow frame mounting assembly of claim 1 wherein said plurality of openings in said receiving plates each having a different diameter.

6. The universal snow plow frame mounting assembly of claim 2 wherein said plurality of openings in said receiving plates each having a different diameter.

7. The universal snow plow frame mounting assembly of claim 3 wherein said plurality of openings in said receiving plates each having a different diameter.

8. The universal snow plow frame mounting assembly of claim 4 wherein said plurality of openings in said receiving plates each having a different diameter.

* * * * *